United States Patent [19]

Mills

[11] Patent Number: 4,686,793

[45] Date of Patent: Aug. 18, 1987

[54] THRESHOLD

[76] Inventor: Norman J. Mills, 820 Aspen Rd., West Palm Beach, Fla. 33409

[21] Appl. No.: 877,306

[22] Filed: Jun. 23, 1986

[51] Int. Cl.[4] ..... E06B 1/70

[52] U.S. Cl. ..... 49/471; 49/470

[58] Field of Search ..... 49/471, 470, 469, 380

[56] References Cited

U.S. PATENT DOCUMENTS

| | | | |
|---|---|---|---|
| 2,010,609 | 8/1935 | Shogren | 49/470 |
| 2,933,781 | 4/1960 | Cornell | 49/469 R |
| 2,976,584 | 3/1961 | Ghormley | 49/470 |
| 4,055,917 | 11/1977 | Coller | 49/469 |

FOREIGN PATENT DOCUMENTS

| | | | |
|---|---|---|---|
| 764538 | 12/1956 | United Kingdom | 49/469 |
| 2046335 | 11/1980 | United Kingdom | 49/471 |

*Primary Examiner*—Philip C. Kannan

*Attorney, Agent, or Firm*—Harvey B. Jacobson

[57] ABSTRACT

An elongated body is provided for use as a threshold and is transversely stepped whereby the body includes high and low opposite side longitudinally extending upper surfaces. The body includes a central upstanding surface extending between the high and low upper surfaces with the latter extending transversely of the body in opposite directions from the upper and lower margins of the upstanding surface. The portion of the low upper surface adjacent the lower margin of the upstanding surface is transversely downwardly inclined theretoward and the body includes transverse inclined passages formed therein with the upper ends of the passages opening through the upright surface lower margin and the lower ends of the passages opening outwardly of the longitudinal marginal portion of the body away from which the upstanding surface faces. The upper margin of the upstanding surface includes an elongated seal strip and the upper extremity of the inclined low upper surface curves downwardly toward the lower extremity of the body for engagement by a door lower edge mounted seal strip.

3 Claims, 4 Drawing Figures

THRESHOLD

BACKGROUND OF THE INVENTION

1. Field of the Invention

This invention relates to a doorway threshold for an exterior door and includes structure for effecting a substantially weathertight seal with the outer surface of the lower marginal edge of an associated door. The threshold includes structures for draining away any moisture flowing downwardly along the outer surface of the associated door and from the lower marginal edge of the outer surface. In addition, the inner margin of the threshold includes a rounded surface against which a weather seal strip carried by the inner marginal portion of the lower edge of the associated door may sealingly abut, thus providing a double weathertight seal between the door and the threshold between which water drain structure is disposed.

2. Description of Related Art

Various different forms of thresholds including some of the general structural and operational features of the instant invention heretofore have been provided. Examples of these different forms of thresholds are disclosed in U.S. Pat. Nos. 299,089, 322,086, 1,729,243, 1,795,853, 2,010,609 and 4,513,536. However, these previously known forms of thresholds do not include the overall combination of structural features which comprise applicant's invention.

SUMMARY OF THE INVENTION

The threshold of the instant invention is transversely stepped and includes a high outer portion and a lower inner portion separated by an upstanding surface facing toward the inner margin of the threshold. The low inner portion includes a low upper surface which is inclined upwardly and outwardly immediately adjacent the upstanding surface and thereafter curves downwardly to form the inner margin of the threshold. Transverse inclined drain openings spaced along the threshold are formed through the outer portion and open through the lower margin of the upstanding surface at their upper inlet ends and through the outer margin of the threshold at their lower discharge ends. The upper margin of the upstanding surface includes a seal strip extending therealong for sealing engagement with the lower margin of the outer face of an associated horizontally swingable door and the downwardly curving inner marginal portion of the upper surface of the low portion is sealingly engageable by seal structure carried by the inner margin of the lower edge of the associated horizontally swingable door to thereby form a pair of weather seals between the threshold and the associated door and between which moisture drainage openings are disposed.

The main object of this invention is to provide a threshold capable of forming an effective weather shield between the threshold and the lower marginal edge portion of an associated horizontally swingable door.

Another object of this invention is to provide a threshold in accordance with the preceding object and including an outer seal area effective to prevent water flowing down the outer face of an associated door from falling downward onto the threshold in a manner such to allow flow of that water inwardly from the inner margin of the threshold.

A final object of this invention to be specifically enumerated herein is to provide a threshold in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
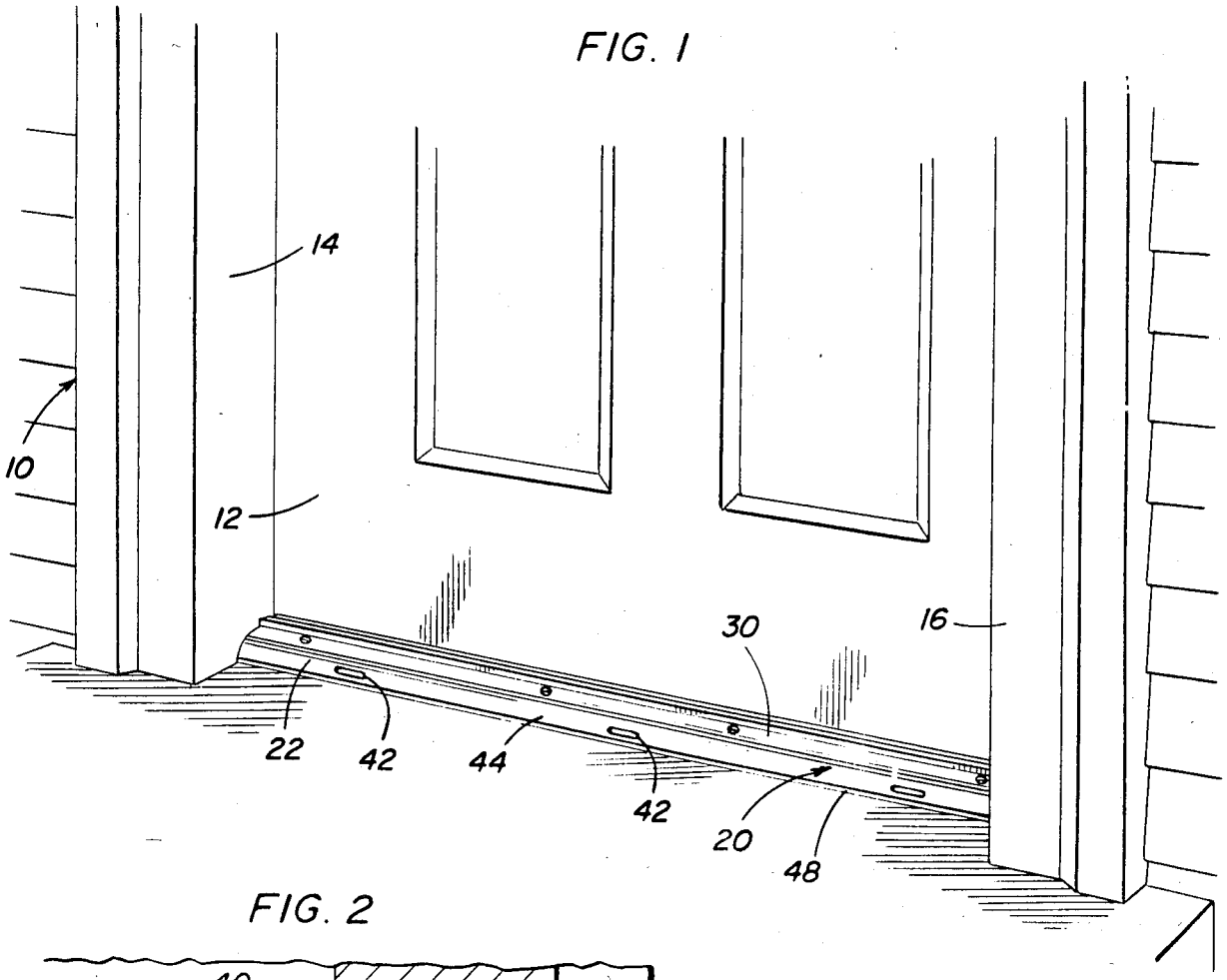
FIG. 1 is a perspective view of the threshold of the instant invention inoperatively associated with an outside door and door frame.

Referring now more specifically to the drawings, the numeral 10 designates an exterior door frame from which an exterior door 12 is horizontally swingably mounted. The frame 10 includes opposite side upright members 14 and 16 supported from a floor structure referred to in general by the reference numeral 18 and the threshold of the instant invention is referred to in general by the reference numeral 20 and extends between the lower ends of the uprights 14 and 16 and overlies and is supported from the floor construction 18.

The threshold 20 comprises a horizontal elongated body 22 defining longitudinal inner and outer portions 24 and 26 disposed on opposite sides of a central upstanding longitudinal surface 28. The portion 26 includes an upper surface 30 disposed at a higher elevation than the corresponding upper surface 32 of the portion 24 and that portion of the upper surface 32 adjacent the surface 28 is inclined downwardly toward the lower margin of the surface 28. However, that portion of the upper surface 32 remote from the surface 28 terminates in a downwardly curving inner marginal surface 34 of the body 22 to be referred to again hereinafter.

The portion 26 includes a T-shaped groove 36 which opens outwardly through the upper margin of the surface 28 and has a corresponding T-shaped margin of a seal strip 38 captively retained therein. The seal strip 38 projects outwardly of the surface 28 and may be engaged by and form a weathertight seal with the lower margin of the outer surface 40 of the door 12. In addition, the portion 26 has three longitudinally spaced passages or inclined slots 42 formed therethrough transversely of the portion 26. The upper ends of the slots 42 open through the lower margin of the surface 28 and the lower ends of the slots 42 open outwardly through the downwardly curving outer marginal edge 44 of the upper surface 30. Further, the portion 26 includes a plurality of vertical bores formed therethrough enabling the threshold 20 to be anchored relative to the floor construction 18 through the utilization of vertical fasteners 44. Also, the opposite side marginal portions of the under surface 46 of the threshold 20 are relieved and include seal strips 48.

Figure 2:
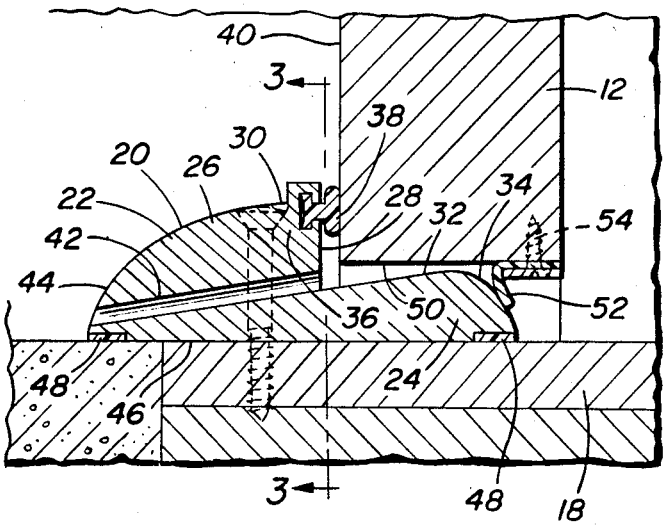
FIG. 2 is an enlarged fragmentary transverse vertical view taken substantially upon a plane passing through the longitudinal center of the threshold illustrated in FIG. 1.
Figure 3:
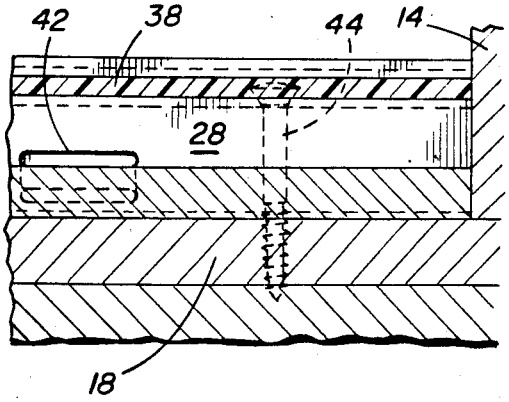
FIG. 3 is a fragmentary vertical sectional view taken substantially upon the plane indicated by the section line 3—3 of FIG. 2.
Figure 4:
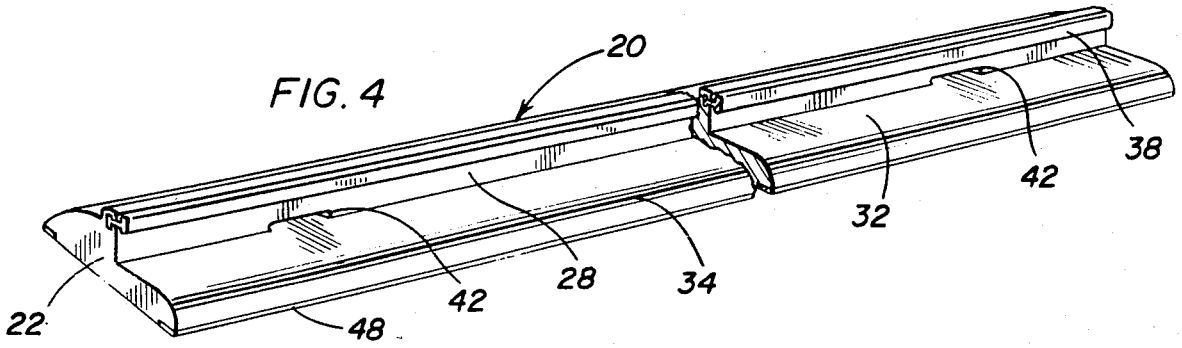
FIG. 4 is a perspective view of the threshold with a mid-portion thereof broken away and illustrated in vertical section.

With attention invited more specifically to FIG. 2, the inner margin of the lower edge 50 of the door 12 includes a preformed resilient seal strip 52 supported therefrom through the utilization of suitable fasteners 54 and the seal strip 52 is engaged with the downwardly curving surface 34 when the door 12 is in the closed position abutted against the seal strip 38. Accordingly, the seal strips 38 and 52 form a double weathertight seal between the door 40 and the threshold 20 and the inlet ends of the drain slots 42 open into the stepped area of the threshold 20 between the seal strips 30 and 52.

If any rain water rolls down the outer face or side 40 of the door 12 as the door 12 is being opened or closed, such water may drip from the lower edge of the door 12 onto the inclined upper surface 32 and be drained outwardly through the slots 42. However, when the door 12 is fully closed, the seal strip 38 will prevent any water flowing downwardly along the outer side 40 of the door 12 from dropping onto the upper surface 32.

The threshold 20 may be constructed of aluminum, plastic or wood, or any other suitable material and the seal strips 38 and 52 may be constructed of any suitable resilient seal strip material such as rubber or neoprene. Also, the seal strips 48 may be constructed of rubber or neoprene.

The lower edge 50 of the door 12 is spaced only slightly above the upper surface 32 and the inner margin of the threshold 20 is displaced outward of a vertical plane containing the inner face of the door 12 when the latter is in the closed position. Accordingly, the seal strip 52 is mounted in a manner such that it may not be readily viewed from the inside of the door. However, the seal strip 52 is operative to form a good weather seal between the door 12 and the threshold 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A threshold including an elongated horizontal body defining longitudinal inner and outer side portions disposed on opposite sides of a central upstanding longitudinal plane extending longitudinally of said body and defining inner and outer side extremities extending along said threshold, said body including high and low outer and inner side portion upper surfaces and a generally upright surface extending betweeen said high and low upper surfaces, facing generally horizontally toward said inner side extremity and including upper and lower margins, said upper surface, adjacent said upright surface, being transversely inclined downwardly toward the lower margin of said upright surface, said outer side portion defining transverse inclined drain passage means therein including upper and lower ends, said passage means upper end opening upwardly through the lower margin of said upright surface at points spaced longitudinally therealong and said lower end of said passage means opening downwardly through said outer side extremity at points spaced therealong, the upper portion of said upright surface including seal strip means extending longitudinally therealong at an elevation above the uppermost portion of said inner portion upper surface and facing outwardly of said upright surface, said upper margin of said upright surface including an outwardly opening groove formed therein, said seal strip means including an elongated seal strip having a transversely enlarged base portion captively retained in said groove, said inclined lower upper surface terminating upwardly in a transversely downwardly curved inner marginal portion of said body defining said inner side extremity, an upright door including inner and outer surfaces and a lower margin terminating downwardly at a downwardly facing lower edge extending between said surfaces, said door being mounted relative to said threshold for horizontal swinging between an open position and a closed position with the outer surface of said door lower margin closely opposing said upright surface and compressively engaging said seal strip means and said lower edge closely overlying said inner side portion upper surface, said lower edge including a depending resilient seal strip supported therefrom intermediate said inner and outer surfaces and sealingly engaging said downwardly curving surface centrally intermediate the arc ends thereof when said door is in the closed position thereof.

2. The threshold of claim 1 wherein said drain openings include horizontal transverse dimensions greater than the transverse vertical dimensions thereof.

3. The threshold of claim 1 wherein said body includes a lower surface, the opposite side marginal portions of said lower surface defining said inner and outer side extremities of said body including downwardly facing seal strips extending longitudinally therealong.

* * * * *